United States Patent [19]

Deemer et al.

[11] Patent Number: 4,995,336

[45] Date of Patent: Feb. 26, 1991

[54] ANIMAL ENTRANCE

[76] Inventors: Mary M. Deemer, 106 E. Seventh St.; Lois K. Kugler, 606 North St., both of Oil City, Pa. 16301

[21] Appl. No.: 514,205

[22] Filed: Apr. 25, 1990

[51] Int. Cl.[5] ..... E05B 65/00

[52] U.S. Cl. ..... 119/15; 119/19; 49/169

[58] Field of Search ..... 119/15, 19, 1; 49/168, 49/169, 170, 171, 380; 160/DIG. 8, 179, 180

[56] References Cited

U.S. PATENT DOCUMENTS

| | | | |
|---|---|---|---|
| 1,101,338 | 6/1914 | Schroes | 49/171 X |
| 2,153,673 | 4/1939 | Nidever | 119/15 X |
| 2,758,646 | 8/1956 | Johnson | 160/DIG. 8 X |
| 2,932,279 | 4/1960 | Giles | 119/15 |
| 3,091,221 | 5/1963 | Worm | 119/19 |
| 3,985,174 | 10/1976 | Bricker | 160/180 |
| 4,022,263 | 5/1977 | Beckett et al. | 160/179 X |
| 4,029,048 | 6/1977 | Gershbein | 119/19 X |
| 4,216,743 | 8/1980 | Cohen | 49/171 X |
| 4,224,899 | 9/1980 | Crunchelow | 119/19 |
| 4,291,645 | 9/1981 | Cruchelow | 119/19 |
| 4,445,459 | 5/1984 | Julie | 119/1 |
| 4,754,797 | 7/1988 | Sronce | 49/169 X |
| 4,760,872 | 8/1988 | Hale, Jr. | 160/90 |
| 4,827,872 | 5/1989 | Sommers | 119/19 |
| 4,829,700 | 5/1989 | Ha | 43/61 |

FOREIGN PATENT DOCUMENTS

| | | | |
|---|---|---|---|
| 0309110 | 3/1989 | European Pat. Off. | 119/15 |
| 2557766 | 7/1985 | France | 119/15 |

OTHER PUBLICATIONS

Sibley, "Winter Quarters for Towser", *Popular Mechanics,* Dec. 1962, p. 147.

*Primary Examiner*—Robert P. Swiatek
*Assistant Examiner*—Todd E. Manahan
*Attorney, Agent, or Firm*—Charles L. Lovercheck; Wayne L. Lovercheck; Dale R. Lovercheck

[57] ABSTRACT

An animal entrance to be installed in a window, made up of an elongated enclosure with a front entrance door, a rear exit door and a swinging door between the front entrance door and the rear exit door. In a second embodiment of the invention, two enclosures, each having an open end and a closed end, are telescoped together to adjust to the window size. Each enclosure has a door adjacent its closed end and a swinging door in one of the enclosures adjacent its opened end is provided, whereby an animal can enter one door, pass through the swinging door and exit the other door thereby going from outside the house to the inside and visa versa.

4 Claims, 1 Drawing Sheet

ANIMAL ENTRANCE

BACKGROUND OF THE INVENTION

This invention relates to animal passageways and more particularly to an entrance for animals to be placed in openings in walls of buildings wherein small animals can pass through the opening, yet larger animals, winds and air drafts are restricted.

This passageway is especially suited for pet cats. It is made in two parts so that one side telescopes into the other as a sleeve, making it adjustable to fit most windows. It is fitted into a window much the same way as an air conditioner. It has an entry in one side adjacent one end, a flap in the middle and an exit in the other side adjacent the other end. This enables a cat or cats to come indoors and go outdoors when the owner is at work or otherwise away from home. This eliminates the need for a bothersome litterbox and allows the cat or cats to get exercise. It is made to have the appearance of a house having a roof, windows and doors.

It is an object of the invention to provide an animal entrance that may be placed in a window or other opening of a house or the like, so that an animal, for example a cat or cats, can enter or exit the house yet weather and large animals are excluded.

Another object is to provide an animal entrance that is simple in construction, economical to manufacture and simple and efficient to use.

Another object is to provide an improved animal entrance.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

Applicant is aware of the following patents. It is believed that none of patents discloses her invention:

3,985,174 Bricker et al.
4,224,899 Cruchelow et al.
4,291,645 Cruchelow et al.
4,445,459 Julie et al.
4,754,797 Sronce et al.
4,760,872 Hale, Jr. et al.
4,827,872 Sommers et al.
4,829,700 Ha et al.

DETAILED DESCRIPTION OF THE DRAWINGS

Figure 1:
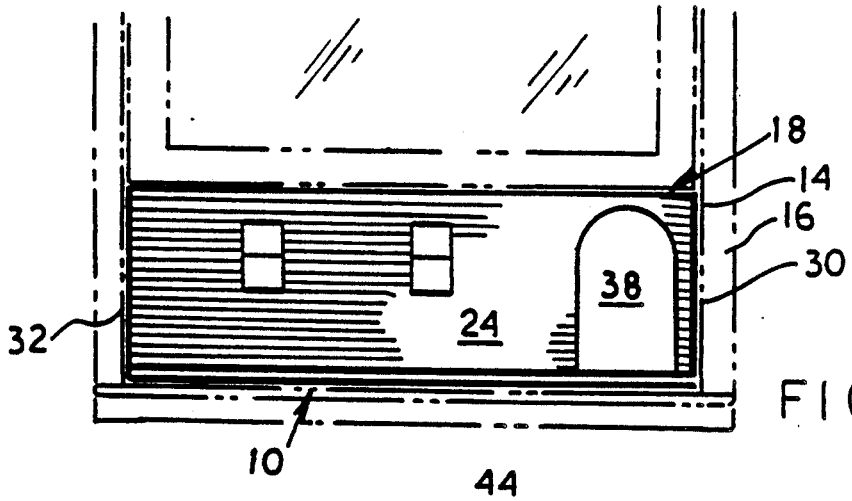
FIG. 1 is a front view of the animal entrance according to one embodiment of the invention.

Now with more particular reference to drawings, animal entrance 10 for an opening 14 in a house or the like, of the first embodiment of the invention, is shown comprising elongated enclosure 18, front wall 24, rear wall 26, spaced from front wall 24 top 34, bottom 36, first closed end 30 and second closed end 32. Front wall 24 has first door opening 38 near first closed end 30. Rear wall 26 has second door opening 40 near second closed end 32.

Swinging door 42, or other movable closure which may be opened by a small animal such as a cat, is provided in elongated enclosure 18, between first door opening 38 and second door opening 40. Swinging door 42, disposed perpendicular to said front wall and to said rear wall, is swingably supported on the top 34 of the enclosure by hinge 20. Hinge 20 could be attached to a side wall and door 42 swung either way from a central position. Swinging door 42 will be of a size to accommodate the particular intended animal user.

Figure 2:
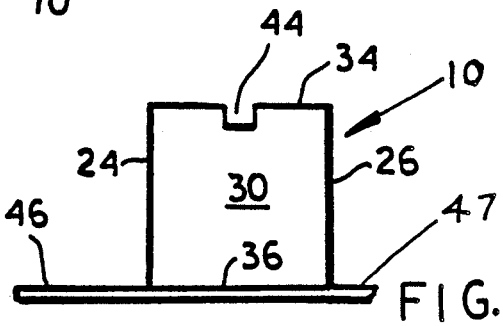
FIG. 2 is an end view of the animal entrance shown in FIG. 1.
Figure 3:
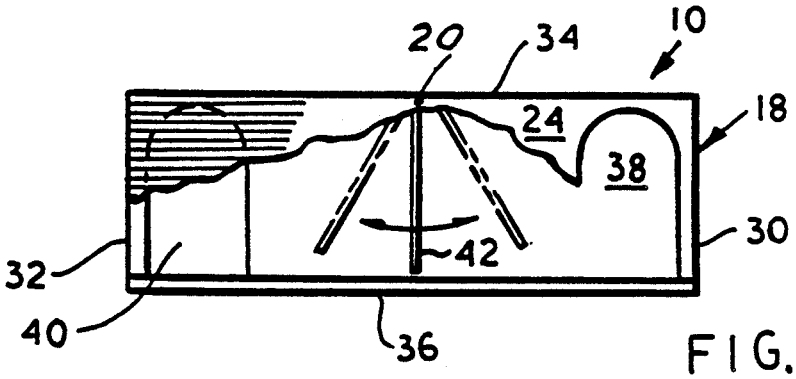
FIG. 3 is a view similar to FIG. 1 with part of the front wall removed.

Longitudinally extending groove 44 is formed in top 34 extending from first closed end 30 to second closed end 32 to receive the lower edge of double hung window 16. Bottom 36 extends outwardly from front wall 24 and from the rear wall 26 providing a patio or porch platform 46 at the front and a rear patio or porch 47 for the convenience of a cat or other animal. Elongated enclosure 18, in the embodiment of FIGS. 1 through 3, is adapted to fit into a window opening of window 16.

Figure 4:
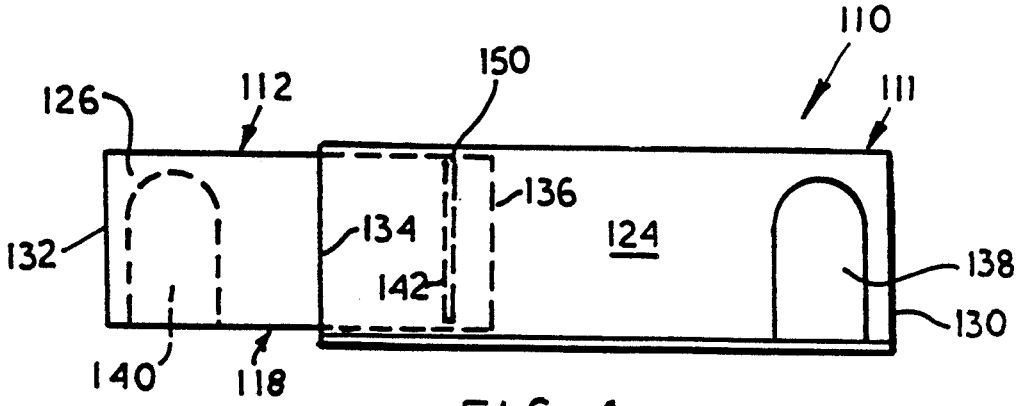
FIG. 4 is a front view of a second embodiment of the invention.

In the embodiment of the invention shown in FIG. 4, animal entrance 110 is designed to be fitted into different sizes of double hung windows as shown in FIG. 1. Animal entrance 110 is made up of first enclosure part 111 and second enclosure part 112. Both first enclosure part 111 and second enclosure part 112 have sides. First enclosure part 111 has front wall 124, a rear wall, first open end 134 and first closed end 130. First door opening 138 is formed in front wall 124 of enclosure 118. Second enclosure part 112 has front wall 126, a rear wall, second open end 136 and second closed end 132.

Second door opening 140 is formed the rear wall of second enclosure part 112 adjacent second closed end 132. A flap or swinging door 142 is swingably supported from the top of second enclosure part 112 at position 150, adjacent second open end 136 of second enclosure part 112. Second open end 136 of second enclosure part 112 is telesopically received in first open end 134 of first enclosure part 111. Thus, animal entrance 110 can be adjusted to fit in a variety of windows of different widths and animals of a given size can enter through swinging door 142 and exit through second door opening 140.

The adjustable width of animal entrance 110 is accomplished by sliding second enclosure part 112 into first enclosure part 111 to fit the particular window in which the animal entrance is to be installed.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. An animal entrance adapted to be received in a window opening of an open window in a wall having a double hung window comprising an elongated enclosure;

said elongated enclosure defined by a front wall, a rear wall spaced from said front wall, a top, a bottom, a first closed end and a second closed end;

a first door opening in said front wall adjacent said first closed end and;

a second door opening in said rear wall adjacent said second closed end defining a passage in said elongated enclosure between said first door opening and said second door opening; and a swinging door in said elongated enclosure disposed generally perpendicular to said front wall and to said rear wall between said first door opening and said second door opening;

said swinging door being swingably supported on said elongated enclosure by hinge means;

said swinging door being urged toward a closed position by gravity whereby an animal can enter said first door opening, pass through said swinging door and exit said second door opening and thereby enter into or exit from one side of said elongated enclosure to the other.

2. An animal entrance for fitting into an opening of a window in a wall comprising:

a first enclosure part and a second enclosure part;

said first enclosure part having a front wall, a rear wall, a first open end and a first closed end;

said second enclosure part having a front wall, a rear wall, a second closed end and a second open end;

a first door opening in said front wall of said first enclosure part adjacent said first closed end;

a second door opening in said rear wall of said second enclosure part adjacent said second closed end of said second enclosure part; and a swinging door disposed in said second enclosure part between said second part and said second door opening forming a closure in said window, said second open end of said second enclosure part being telesopically received in said first open end of said first enclosure part whereby said animal entrance can fit into said window and whereby an animal can enter said first door opening, through said first door opening, pass through said swinging door and exit through said second door opening.

3. The animal entrance recited in claim 2 wherein a longitudinally extending groove is formed in said top of said elongated enclosure;

said groove extending from said first closed end to said second closed end to receive a lower edge of said window.

4. The animal entrance recited in claim 2 wherein said bottom of said elongated enclosure extends outwardly from said front wall providing a platform.

* * * * *